US005398734A

United States Patent [19]

Härtel

[11] Patent Number: 5,398,734

[45] Date of Patent: Mar. 21, 1995

[54] APPARATUS FOR MONITORING THE THERMAL TREATMENT OR STERILIZATION OF BOTTLES OR SIMILAR CONTAINERS IN A CONTAINER-TREATMENT MACHINE

[75] Inventor: Manfred Härtel, Bretzenheim, Germany

[73] Assignee: KHS Maschinen- und Anlagenbau Aktiengesellschaft, Duisburg, Germany

[21] Appl. No.: 126,530

[22] Filed: Sep. 24, 1993

[30] Foreign Application Priority Data

Sep. 26, 1992 [DE] Germany ..... 42 32 323.1

[51] Int. Cl.[6] ..... B65B 3/30

[52] U.S. Cl. ..... 141/82; 141/83; 141/92; 141/89; 141/97; 141/48

[58] Field of Search ..... 141/82, 83, 97, 92, 141/89, 85, 48, 39, 6

[56] References Cited

U.S. PATENT DOCUMENTS 4,989,649 2/1991 Weiler et al. ..... 141/85 X
5,031,673 7/1991 Clüsserath ..... 141/6
5,163,487 11/1992 Clüsserath ..... 141/6
5,167,266 12/1992 Diehl et al. ..... 141/97

FOREIGN PATENT DOCUMENTS 1492384 10/1969 Germany .
2747809 1/1979 Germany ..... 141/82
3809855 2/1989 Germany .
1742131 6/1992 U.S.S.R. ..... 141/82
8203832 11/1982 WIPO ..... 141/82

*Primary Examiner*—Ernest G. Cusick
*Attorney, Agent, or Firm*—Robert W. Becker & Associates

[57] ABSTRACT

An apparatus for monitoring the thermal treatment or sterilization of bottles or similar containers in a container-treatment machine that has a transport element that, for treatment at treatment stations, moves containers along a transport section between a container inlet and a container outlet. Thermal treatment of the containers with a hot medium is effected in a portion of the transport section. For monitoring purposes, at least one temperature sensor is provided for measuring the temperature of containers that have been heated up by the hot medium.

23 Claims, 3 Drawing Sheets

APPARATUS FOR MONITORING THE THERMAL TREATMENT OR STERILIZATION OF BOTTLES OR SIMILAR CONTAINERS IN A CONTAINER-TREATMENT MACHINE

BACKGROUND OF THE INVENTION

The present invention relates to an apparatus for monitoring the thermal treatment or sterilization of bottles or similar containers in a container-treatment machine having a transport element that, for treatment at treatment stations, moves containers along a transport section between a container inlet and a container outlet, with thermal treatment of the containers being effected with a hot medium in at least a portion of the transport section.

The beverage industry frequently faces the problem of dispensing beverages, such as fruit juices or the like, in an unheated state and without the use of chemical additives into bottles in such a way that an adequate shelf life of the dispensed and sealed-off product is ensured. In order to accomplish this, the bottles, prior to introducing filling material therein, must have a high degree of sterility and freedom from bacteria.

In this connection, it is known to treat the interior of containers in a filling machine with hot sterilization medium in the form of steam directly prior to the filling phase and possibly prior to a pressurization phase that precedes the filling phase. To improve the quality of the sterilization, it has already been proposed to provide at the individual filling stations, i.e. at the filling elements of the filling machine that exist at that location, bells that completely accommodate the containers, especially during the sterilization phase (see U.S. Pat. No. 5,163,487, Clsserath).

It is an object of the present invention to provide an apparatus with which it is possible to reliably monitor the thermal treatment or sterilization.

BRIEF DESCRIPTION OF THE DRAWINGS

This object, and other objects and advantages of the present invention, will appear more clearly from the following specification in conjunction with the accompanying schematic drawings, in which.

SUMMARY OF THE INVENTION

The apparatus of the present invention is characterized primarily by at least one temperature sensor for measuring the temperature of a container that has been heated up by the hot medium.

With the inventive apparatus, the at least one sensor is preferably a sensor that operates without contact, in other words, a sensor that, on the basis of the thermal or infrared radiation that is radiated from the container that is to be measured, detects the temperature of this container, or at least the temperature of the outer surface of this container, or delivers a corresponding electrical signal. The at least one sensor is a pyrometer or a sensor that operates pursuant to the principle of a pyrometer.

The at least one sensor preferably comprises only a single sensor for all of the treatment stations of the container-treatment machine, and in particular is disposed adjacent to the transport element, although it does not move along with this element. This sensor then preferably detects the temperature of each individual container, with this temperature then being individually evaluated and analyzed.

The container-treatment machine is, for example, a filling machine or a high-temperature rinser, and has a transport element that is formed by a rotor.

Further specific features of the present invention will be described in detail subsequently.

DESCRIPTION OF PREFERRED EMBODIMENTS

Figure 1:
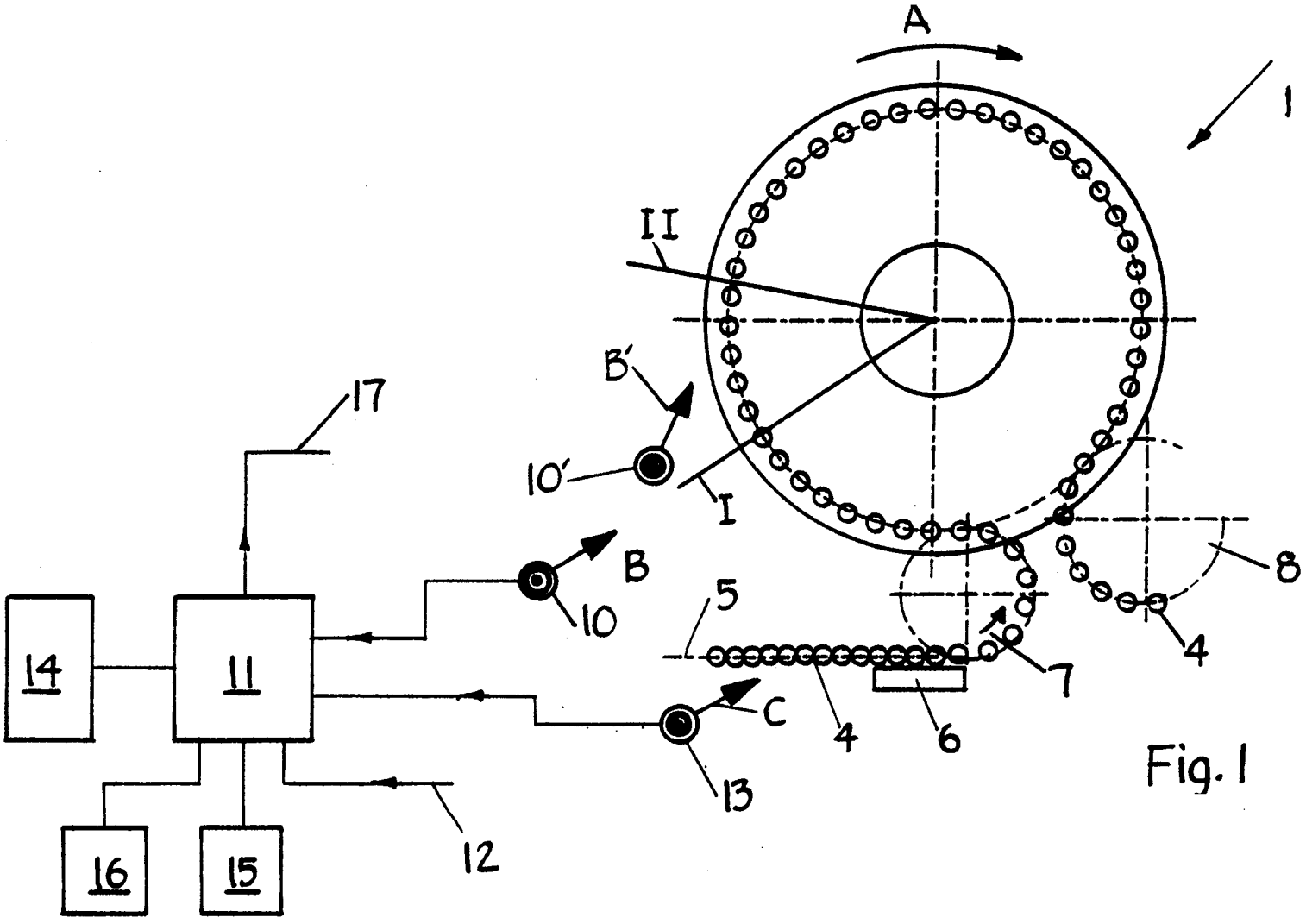
FIG. 1 is a plan view of a rotating-type filling machine for the sterile dispensing of liquids into bottles.
Figure 2:
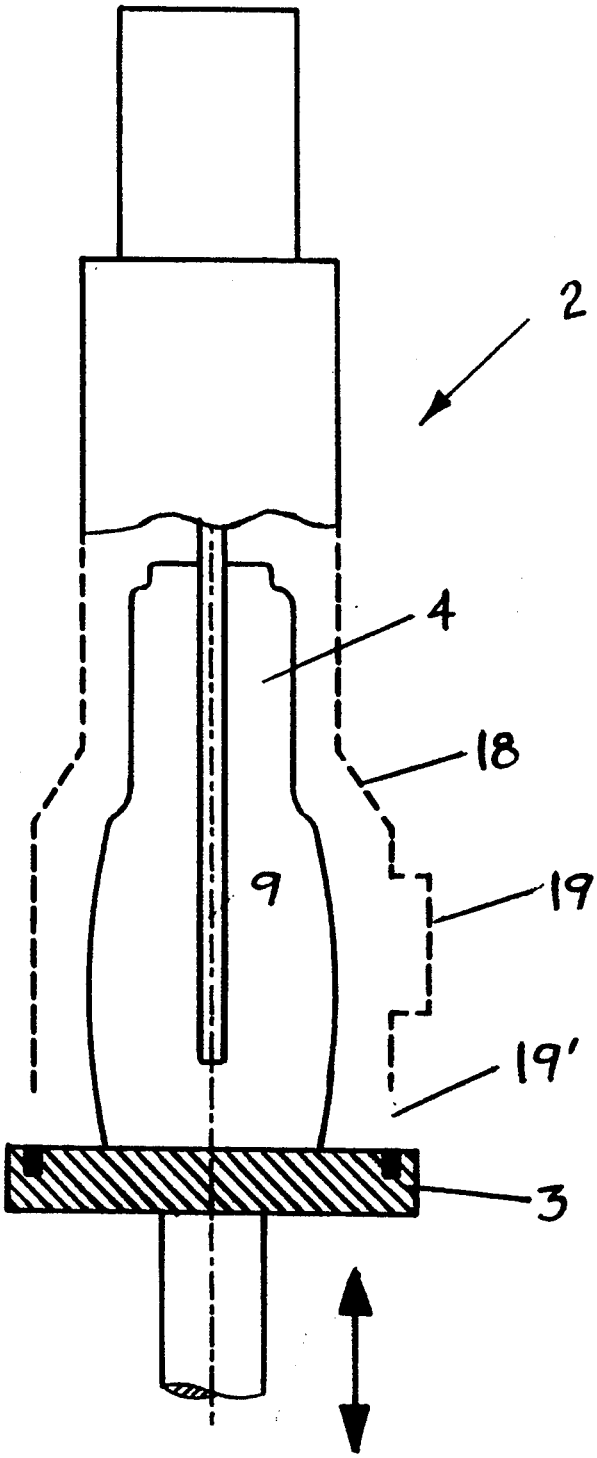
FIG. 2 is a very simplified schematic cross-sectional view of a filling element of the filling machine of FIG. 1 provided on the periphery of a rotating rotor, with a bottle also being shown.

Referring now to the drawings in detail, the filling machine illustrated in FIG. 1 essentially comprises a rotor 1 that rotates in the direction of the arrow A about a vertical machine axis. Formed on the periphery of the rotor 1 are a plurality of filling stations, each of which in a customary manner comprises a filling element 2 and a bottle support means 3 that can be raised and lowered via a lifting mechanism (FIG. 2).

In FIG. 1, all of the filling stations between a bottle inlet and a bottle outlet are indicated as being respectively occupied by a bottle 4.

The bottles 4 that are to be filled are supplied to the filling machine via transport means 5 in an upright manner and as a tightly packed together, single track stream of bottles which is then provided with the appropriate machine spacing via a separating or screw-type conveyor 6 and is transferred by an inlet star 7 to the individual filling stations of the rotor 1. The filled bottles 4 are removed from the filling stations at an outlet star 8 and are conveyed to a non-illustrated closure or capping mechanism.

Following the inlet star 7, when viewed in the direction of rotation A of the rotor 1, first, prior to the actual filling phase in which the liquid filling material is conveyed to the respective bottle 4 via the filling element 2, and in the illustrated embodiment also prior to a pressurizing phase that precedes the filling phase, there is effected a sterilization of the respective bottle 4, in other words, this bottle 4 is treated with a hot sterilization medium, namely steam. The steam is supplied to the interior of the respective bottle 4 via the filling tube 9 of the filling element 2, or via a gas tube, flows about the interior of the bottle 4 and in particular also in the region of the base of the bottle as well as the bottle walls, and exits at the mouth of the bottle. The sterilization medium also effects a heating of the respective bottle 4 to a sterilization temperature, i.e. to a temperature that ensures an adequate sterilization and freedom from bacteria of the respective bottle 4. In the illustrated embodiment, the angular range of the rotational movement of the rotor 1 during which the treatment with the sterilization medium is effected extends from the inlet star 7 to the position I. In the following angular range of the rotational movement of the rotor 1 between the positions I and II there is essentially effected a displacement of the sterilization medium out of the bottle 4 and a subsequent pressurization of the bottle 4 with a compressed or inert gas.

The shelf life of the filling material that is dispensed into the bottles 4 depends in particular on whether or not a freedom from bacteria to the required extent has actually been achieved for each bottle 4, in other words, whether during the and/or at the end of the treatment with the sterilization medium at least the inner surfaces as well as the mouth of the bottle, including adjacent regions of the bottle, have obtained for a predetermined period of time a temperature that is adequate to reliably destroy any bacteria that is present. In the interest of as great a capacity of the filling machine as possible, as well as in the interest of using as little sterilization medium as possible, it is furthermore desirable that the intensity of the treatment with the sterilization medium does not too greatly exceed the desired state that ensures freedom from bacteria.

To measure the temperature of the bottles 4, a temperature sensor 10 is provided at the position I on a holding means or machine element that does not rotate along with the rotor 1. The sensor 10 detects the temperature of the bottles that are moving past without contacting the same, and in particular at a prescribed region of the outer surface of the bottles.

The sensor 10 is, for example, a pyrometer, or operates according to the principle of such a pyrometer, in other words for example radiation or optical or spectro pyrometers such that the temperature of the outer surface of the bottle 4 is determined from the intensity of the heat or infrared radiation that is radiated from the respective bottle 4 in one or more wave length ranges. The direction of measurement of the sensor 10 is indicated in FIG. 1 by the arrow B; i.e. the sensor 10, which is disposed beyond the rotor 1 relative to the radial machine axis of the rotor, detects the bottles 4 that are passing by in an axial direction radial to the machine axis, in other words the thermal or infrared radiation that is radiated by the bottles 4 strikes the sensor 10 radially relative to the machine axis.

In order to be able to reliably detect individual bottles 4 and/or sudden temperature changes, the sensor 10 has a very short operating or response time, which is, for example, of the order of magnitude of at most 10 milliseconds. This short operating time, however, then also makes it necessary that the sensor 10 be controlled within the cycle of the filling machine or that the measurement signal delivered by the sensor 10 be evaluated in this machine cycle in the evaluation and control electronics 11 that are connected with the sensor 10. In this way, by means of the sensor 10 or the measurement signal delivered thereby, in fact only the bottles 4 and not the gaps formed between the bottles or the filling stations of the rotor 1 are detected.

Alternatively or in addition to the above, it is also possible to embody the sensor 10 and the evaluation and control electronics 11 such that only the greatest temperature or the corresponding measurement signal measured within a prescribed time period, for example within a machine cycle, are noted or stored and are used for further processing.

Especially when the filling stations and hence the bottles 4 have only an extremely slight angular spacing from one another on the rotor 1, it is also possible to provide the sensor such that relative to its measuring direction it is oriented at an angle to the radius to the vertical machine axis, as is indicated by the arrow B′ for the sensor 10′. With such an orientation of the sensor 10′, gaps between the individual bottles 4 at the filling stations are barely detected.

The reference numeral 12 indicates a signal line via which the machine cycle is fed to the evaluation and control electronics 11.

A further sensor 13, which corresponds to the sensor 10, is provided at the transport means 5 directly ahead of the conveyor 6. Again without contact, the sensor 13 measures the temperature of the bottles 4 that are supplied to the filling machine. So that the measurement signal that is also delivered by the sensor 13 to the evaluation and control electronics 11 also in fact corresponds to the temperature of the bottles 4, and so that this signal is not falsified by possible gaps between the bottles 4, the sensor 13 is oriented such that the direction of measurement or operation, which is indicated by the arrow C, extends at an angle to the row of bottles formed at the filler inlet; in other words, this measurement direction forms an angle of less than 90° with the longitudinal extension of this row of bottles. As a result of this orientation, a uniform measuring surface is provided for the sensor 13.

In principle it is, however, also possible to embody the sensor 13 and the evaluation and control electronics 11 such that during a prescribed period of time only the greatest temperature or the corresponding measurement signal measured by the sensor 13 is stored and used for further processing.

Associated with the evaluation and control electronics 11 is a memory means 14 in which are stored at least that data that is relevant for monitoring the sterilization temperature of the bottles 4 via the sensors 10 or 10′, i.e. for example the minimum temperature of the outer surface of the bottles 4 that is to be measured by the sensor 10 or 10′ for the desired quality of the sterilization or freedom from bacteria as a function of the temperature of the bottles 4 measured by the sensor 13 at the inlet to the filler as well as a function of further parameters that determine the measurement or monitoring, such as speed of rotation of the rotor 1 or sterilization time, ambient temperature, shape of the bottle, volume of the bottle, thickness of the wall or glass of the bottles 4, etc. The memory means 14 preferably also contains data that, taking into consideration the aforementioned parameters and the temperatures measured by the sensors 10 or 10′ and 13, make it possible to determine the actual temperature at the inner surface of the respective bottle 4.

The aforementioned data are determined, for example, by tests and are fed to the memory means 14 as sets of curves or data. An input means 15 as well as an indicator display 16 (for example a computer screen) are provided for the input of data and/or for the control of the evaluation and control electronics 11, i.e. in particular for special commands.

The input means 15 can furthermore also serve for the input of a respectively desired or required sterilization temperature that is then similarly stored by the memory means 14 as a minimum theoretical or threshold value that is to be achieved.

The reference numeral 17 indicates a control line to which the output signal of the evaluation control electronics is connected.

In the simplest case, the monitoring and control mechanism that is provided with the sensors 10 or 10′ and 13 as well as the pertaining evaluation and control electronics 11 operates such that during the operation of the filler, the temperature of the bottles 4 that pass by the sensor 10 or 10′ is continuously monitored. If the measured temperature, which is determined by the temperature of a bottle 4 at the position I, by the temperature of the bottles 4 at the filler inlet, as well as by taking into consideration the further parameters, falls below the fixed threshold value, an output signal that is supplied to the appropriate filling station via the control line 17 causes the filling element 2 of this filling station to remain closed or to close, thereby preventing or interrupting filling of the pertaining bottle 4. At the same time, an optical or audible signal that indicates a disruption can be provided, and the display 16 can indicate the filling station at which the temperature dropped below the threshold value.

It is also possible, via the control line 17, to control the temperature of the sterilization medium and/or the quantity of the sterilization medium in the sterilization phase to achieve an optimum sterilization.

The dash lines in FIG. 2 indicate a bell 18 that is provided at each filling element 2 and that can completely accommodate the respective bottle 4 and that at least during the sterilization phase, at least for a given period of time, can have its open underside tightly closed off by the bottle plate or support means 3. In this sealed-off bell 18, during the sterilization phase, the treatment of the bottle 4 with the sterilization medium is then effected, and in particular for example at an overpressure. To be able to measure the temperature with the sensor 10, the bell 18 has a window 19 that is made of a material through which thermal radiation can pass. The window 19 can also be provided with a flap or other suitable closure that is then opened only briefly for the temperature measurement when a filling station, i.e. a bell 18, passes the sensor 10. It is furthermore also possible to briefly lower the bottle support means 3 when it passes the sensor 10 to such an extent that the lower portion of the bottle 4 extends out of the bell 18 so that it is possible for the sensor 10 to measure the temperature through the gap 19' that is formed between the bell 18 and the bottle support means 3.

In order to also take into account possible fluctuations of the temperature of the bottles 4 at the inlet to the filler, the evaluation of the temperatures measured at a bottle 4 by the sensor 10 or 10' is respectively effected taking into consideration the temperature measured for this bottle 4 by the sensor 13. The coordination of the temperature measured by the sensor 13 with a temperature measured by the sensor 10 or 10' is also possible in response to the machine cycle because the number of bottles 4 located between the measurement locations formed by the sensors 13 and 10, 10' is known.

In the embodiment described, it was assumed that the sensor 10 or 10' was disposed directly at the end of the angular range of the rotational movement of the rotor 1 provided for the sterilization phase. However, in principle it is also possible to provide a sensor 10 or 10' at any location in the angular range determined between the points I and II. Furthermore, it is possible to provide the sensor 13 in such a way that it detects the bottles 4 in the conveyor 6.

In principle, it is also possible to provide at each filling station of the rotor 1 a temperature sensor with which it is then possible to detect not only the temperature at the start of the sterilization phase but also the temperature at the end or after the sterilization phase. These two temperatures are again evaluated by an evaluation and control electronics that is either provided for each filling station or a group of filling stations, or in common for all of the filling stations of the filling machine.

Figure 3:
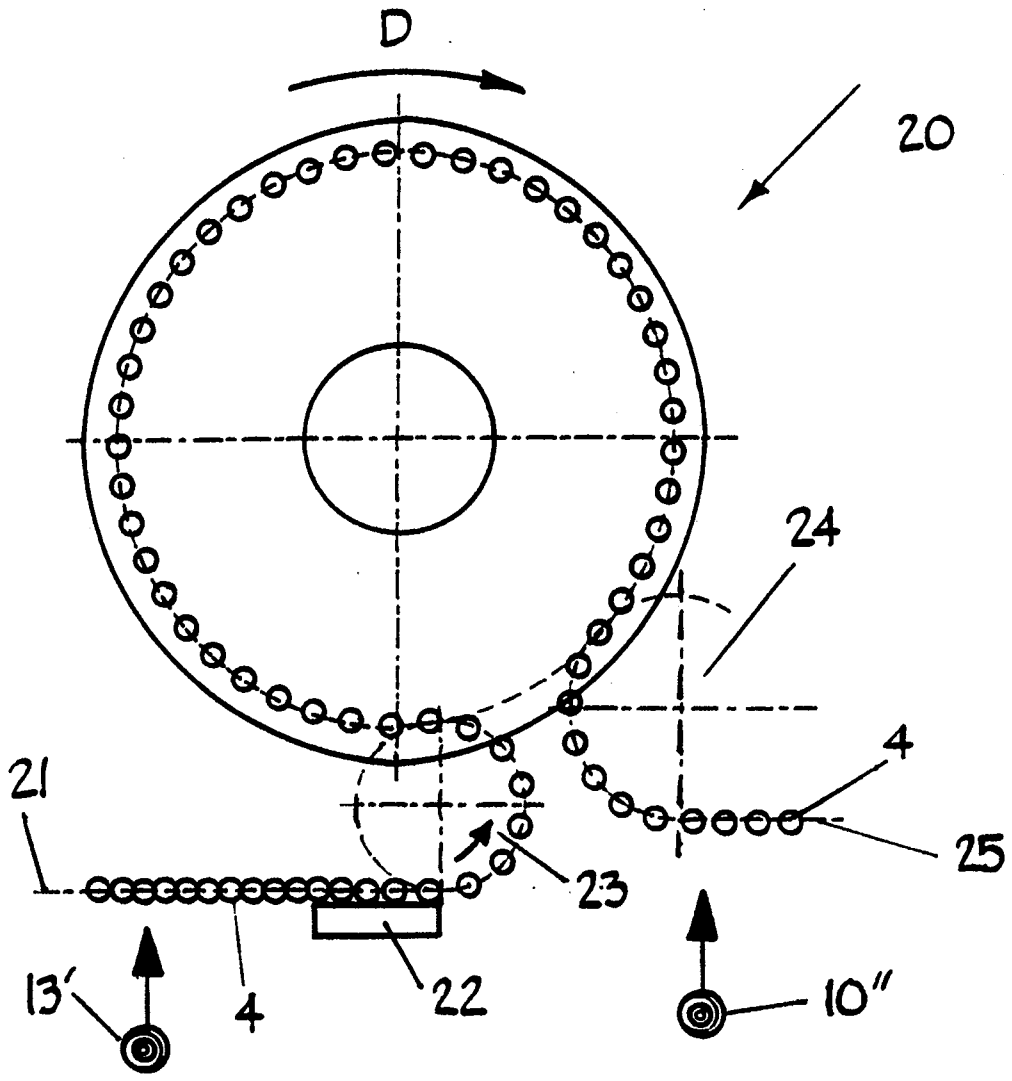
FIG. 3 is a view similar to that of FIG. 1 of a rotating-type high-temperature rinser.

FIG. 3, in a view similar to that of FIG. 1, shows a high-temperature rinser with a rotor 20 that rotates about a vertical axis; formed on the periphery of the rotor are a plurality of treatment stations that each have at least one bottle grasping means.

The bottles 4, which are supplied via the transport means 21 and are placed at the appropriate machine spacing via the separating or screw-type conveyor 22, are conveyed via the inlet star 23 to the rotor 20 or bottle grasping means thereof. By means of the rotor, which rotates in the direction of the arrow D, the bottles 4, after they have been treated, pass via the outlet star 24 to the transport means 25, which carries the bottles 4 away. For monitoring purposes, provided at the inlet to the rinser, i.e. directly ahead of the conveyor 22 or in the region thereof, is a sensor 13' that corresponds to the sensor 13 and operates without contact; provided at the outlet to the rinser, i.e. at the outlet star 24, is a sensor 10" that corresponds to the sensor 10. The sensors 10" and 13', which operate without contact, are again, in the same way as previously described for the sensors 10 or 10' and 13, connected to an evaluation and control electronics 11 that via its signal line 17 delivers an output signal that triggers an alarm and/or shuts the rinser down if the temperature falls below the lower threshold value for the temperature at the sensor 10". Alteratively or in addition thereto, it is also possible, with the signal delivered by the evaluation and control electronics, to control the temperature of the hot treatment medium and/or the intensity, i.e. the quantity of treatment medium and/or the time period for treatment. With this embodiment, the sensor 13' is oriented such that the direction of measurement or operation thereof is directed perpendicular to the row of bottles at the inlet to the rinser; this is necessary if the bottles 4 are to be individually detected. However, in principle it is also possible to orient the sensor 13' in such a way that the direction of measurement or operation thereof extends at an angle to the row of bottles.

It is furthermore possible, as a deviation from the previously described processing and evaluation of the signals of the sensor 10 or 10' and 13 or the sensors 10" and 13', to respectively monitor only the presence of a sufficient difference of the measured temperatures at the sensors 10' or 10 and 13 or at the sensors 10" and 13'; if this temperature difference is not present, the control and evaluation electronics 11 delivers the output signal to the control line 17. However, in principle it is also possible to combine this simplified processing or evaluation of the signals of the sensors with the previously described evaluation. The bottle or container handling machine on which the sensors for detecting the temperature are provided can also be a device for preheating containers or bottles.

The present invention is, of course, in no way restricted to the specific disclosure of the specification and drawings, but also encompasses any modifications within the scope of the appended claims.

What I claim is:

1. An apparatus for monitoring the thermal treatment of containers in a container-treatment machine having a transport element that, for treatment at treatment stations, moves containers along a transport section between a container inlet and a container outlet, with thermal treatment of said containers being effected with a hot medium in at least a portion of said transport section, said apparatus comprising:

at least one temperature sensor for measuring the temperature of one of said containers that has been heated up by said hot medium.

2. An apparatus according to claim 1, which includes at least on further temperature sensor for measuring the temperature of said container prior to said thermal treatment.

3. An apparatus according to claim 2, wherein each of said temperature sensors is a sensor that operates without contact.

4. An apparatus according to claim 1, wherein each of said -treatment stations of said container-treatment machine is provided with at least one of said at least one temperature sensor.

5. An apparatus according to claim 4, wherein said at least one sensor is adapted to detect the temperature of said container not only prior to but also after said thermal treatment.

6. An apparatus according to claim 2, wherein at least one sensor is provided in common for all of said treatment stations or for a group of said treatment stations.

7. An apparatus according to claim 1, wherein a first sensor is disposed at said transport section between said container inlet and said container outlet, and a second sensor is disposed in the region of one of said container inlet and at a transport means that leads to said container inlet.

8. An apparatus according to claim 1, wherein a first sensor is disposed at one of said container outlet and at a transport means that leads away from said container outlet, and a second sensor is disposed in the region of one of said container inlet and at a transport means that leads to said container inlet.

9. An apparatus according to claim 1, wherein said at least one sensor has a measuring direction that extends perpendicular to a direction of movement of containers.

10. An apparatus according to claim 2, wherein at least one sensor has a measurement direction that extends-at an angle to the direction of movement of containers, forming an angle of less than 90° with said direction of movement.

11. An apparatus according to claim 2, wherein a measurement signal delivered by one of said sensors is adapted to be detected within a cycle of a container that moves past said sensor.

12. An apparatus according to claim 2, wherein an evaluation and control circuitry is provided for cooperating with said sensors to form a measurement result.

13. An apparatus according to claim 12, wherein said evaluation and control electronics delivers an output signal as a function of a signal from said sensor and possibly also as a function of further parameters that affect temperature measurement, including capacity of said container-treatment machine, conveying speed of said transport element, ambient temperature, type of container, shape of container, and mass or wall thickness of said container.

14. An apparatus according to claim 12, wherein said evaluation and control circuitry delivers an output signal as a function of the measurement result of the temperature of containers prior to and after said thermal treatment.

15. An apparatus according to claim 12, wherein said evaluation and control circuitry compares said measurement result with a theoretical or threshold value and, if said measurement result falls below said threshold value, delivers to a control line an output signal that, for example, effects an optical and/or audible alarm and/or shuts said container-treatment machine or at least a treatment station thereof off.

16. An apparatus according to claim 1, wherein said container-treatment machine is a filling machine that is provided with a plurality of filling stations, which are provided on the periphery of said transport element, which is a rotor that rotates about a vertical machine axis.

17. An apparatus according to claim 16, wherein said at least one sensor detects the temperature at a position of a movement of rotation of said rotor that follows an angular range of said rotational movement of said rotor that corresponds to a sterilization phase.

18. An apparatus according to claim 16, wherein each of said filling stations is provided with a bell for completely accommodating a respective container, with said bell having at least one opening to allow said at least one sensor to detect the temperature of a container disposed in said bell.

19. An apparatus according to claim 16, which includes evaluation and control electronics for at least one of closing and keeping closed a liquid flow valve of a respective filling station.

20. An apparatus according to claim 1, wherein said container-treatment machine is a sterilizer or a high-temperature rinser.

21. An apparatus according to claim 3, wherein each of said temperature sensors is in the form of a pyrometer or a sensor that operates in the manner of a pyrometer.

22. An apparatus according to claim 2, wherein the greatest amplitude or value of a measurement signal delivered by one of said sensors is stored for a later evaluation.

23. An apparatus according to claim 17, wherein said at least one sensor does not rotate along with said rotor.

* * * * *